US008381634B2

(12) United States Patent
Eaglestone

(10) Patent No.: US 8,381,634 B2
(45) Date of Patent: Feb. 26, 2013

(54) FIELD GUN CARRIAGE

(75) Inventor: David Andrew Eaglestone, Barrow-in-Furness (GB)

(73) Assignee: BAE Systems plc, London (GB)

( * ) Notice: Subject to any disclaimer, the term of this patent is extended or adjusted under 35 U.S.C. 154(b) by 176 days.

(21) Appl. No.: 13/001,188

(22) PCT Filed: Jun. 10, 2009

(86) PCT No.: PCT/GB2009/050647

§ 371 (c)(1),
(2), (4) Date: Dec. 23, 2010

(87) PCT Pub. No.: WO2009/156749

PCT Pub. Date: Dec. 30, 2009

(65) Prior Publication Data

US 2011/0100207 A1 May 5, 2011

(30) Foreign Application Priority Data

Jun. 26, 2008 (EP) ..... 08252202
Jun. 26, 2008 (GB) ..... 0811760.8

(51) Int. Cl.
*F41A 23/46* (2006.01)
*F41A 23/28* (2006.01)

(52) U.S. Cl. ..... 89/40.11; 89/40.02

(58) Field of Classification Search ..... 89/40.02, 89/40.09, 40.11, 40.12, 37.13, 37.14
See application file for complete search history.

(56) References Cited

U.S. PATENT DOCUMENTS 2,016,717 A * 10/1935 Herlach ..... 89/40.11
2,125,186 A * 7/1938 Krum ..... 89/40.11
6,024,007 A 2/2000 Searle et al.

FOREIGN PATENT DOCUMENTS

EP 0 128 996 * 12/1984
FR 491.111 11/1914
GB 761708 11/1956
GB 167466 2/2000

OTHER PUBLICATIONS

International Search Report, dated Sep. 29, 2009.
Extended European Search Report, dated Dec. 4, 2008.
Search Report, dated Oct. 14, 2008.
International Preliminary Report on Patentability dated Jan. 13, 2011.

* cited by examiner

*Primary Examiner* — Stephen M Johnson
(74) *Attorney, Agent, or Firm* — Scully, Scott, Murphy & Presser, P.C.

(57) ABSTRACT

There is disclosed a field gun that may be converted between a firing condition and a travelling condition. In the firing condition, front legs and back legs rest on the ground and support the gun. In the travelling condition, the back legs are out of contact with the ground and the front legs are retracted towards the gun chassis. To facilitate conversion, a link joins a front leg to a back leg so that as the back leg is lifted off the ground, the front leg is retracted.

13 Claims, 4 Drawing Sheets

FIELD GUN CARRIAGE

Figure 1A:
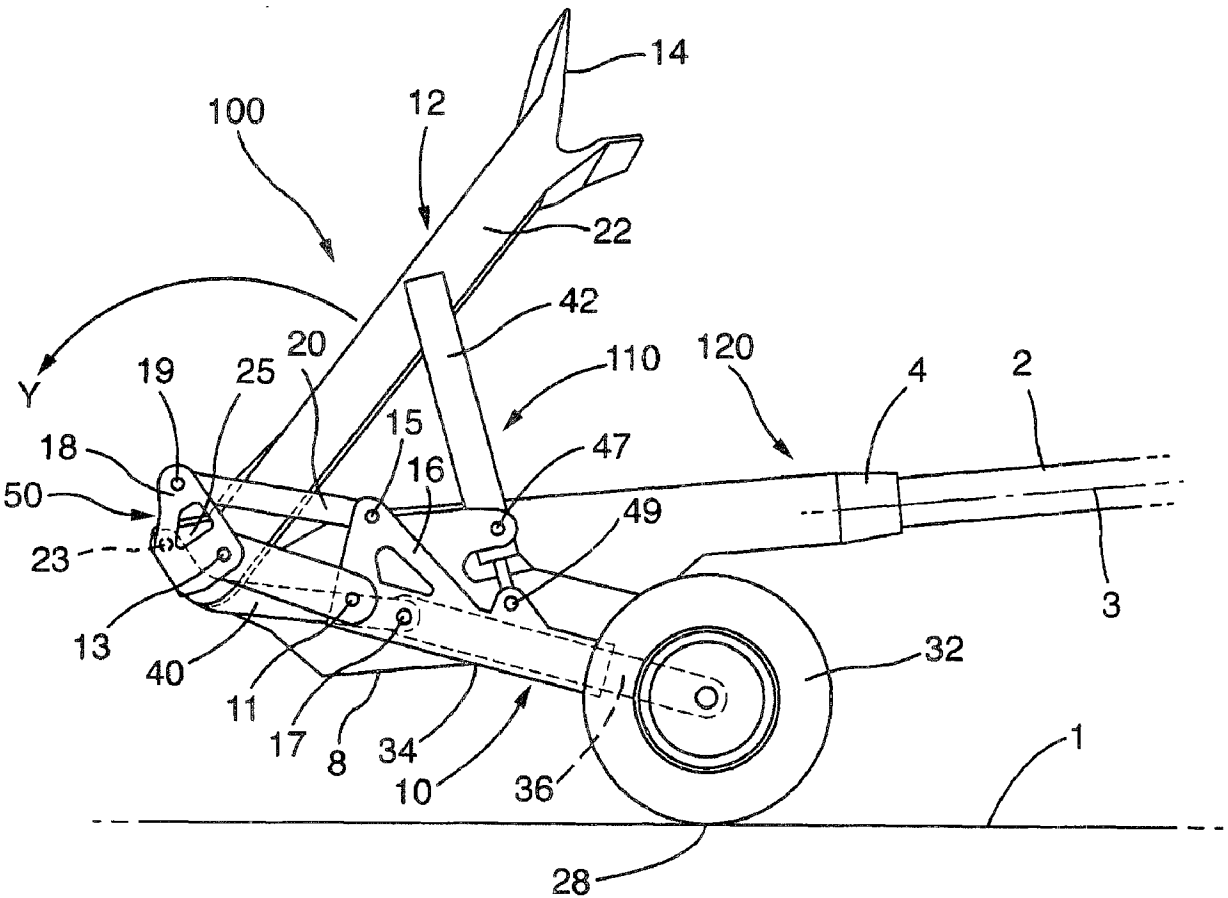

The following invention relates to a carriage for a field gun, the field gun being convertible between a travelling condition and a firing condition.

In a firing condition, a field gun generally has a structure that should withstand the forces encountered during the firing of a projectile from the gun barrel. Such forces include: the recoil force which is exerted on the gun as the gun reacts against the firing of the projectile; and the counter-recoil force which succeeds the recoil force, occurring as the elastic strain energy, stored by the gun over the course of the recoil force, is released. The gun should also be capable of counteracting any tipping moments whilst in the firing position. In order to withstand the forces and counteract the moments, field guns in firing conditions are generally securely engaged with the ground.

In a travelling condition, a field gun should be easy to tow by a propulsion device, for example a truck. Therefore, in the travelling condition, the field gun should be able to move freely relative to the ground.

Thus, in general, the requirements for a firing structure and a travelling structure are in conflict and so a single condition of the field gun does not tend to be satisfactory in providing a stable base for firing and a freely moving platform for towing.

It is known to have a field gun carriage that has both a firing condition and a travelling condition.

155 mm caliber field guns such as the M777 lightweight howitzer and the FH-70 howitzer have therefore been provided with components which can be relocated between a firing configuration and a travelling configuration.

By manipulating each and every one of these components between their firing configuration and travelling configuration the field gun as a whole can be converted between a firing condition and a travelling condition. Manipulation is generally undertaken manually by a field gun crew.

However, the process of manipulating the components can be time consuming because in general each component must be individually manipulated so as to effect its relocation.

Further, the manipulation of some components requires considerable manpower and so crews for manning the gun must be carefully selected and/or sufficiently large.

Still further, the manipulation of some components can be dangerous to the crew, particularly if the component is heavy and able to fall undamped under its own weight as it relocates between the firing and travelling configuration.

Each of these factors tends to contribute to the time it takes to convert the gun between conditions. It is desirable to minimise this conversion time so that the gun can be deployed into action as quickly as possible. In the situation where the gun is to be fired and moved and fired again, for example for strategic battlefield reasons, a gun that tends to be quick to deploy is implicitly a gun that can achieve a higher firing rate.

It is an object of the present invention to provide a field gun carriage that tends to be easily deployable and/or mitigates at least one of the above disadvantages of known convertible field guns.

Accordingly there is provided a carriage for a field gun, the field gun being convertible between a travelling condition and a firing condition, the carriage comprising:

a first component for occupying a first travelling configuration when the gun is in the travelling condition, and for occupying a first firing configuration when the gun is in the firing condition;

a second component for occupying a second travelling configuration when the gun is in the travelling condition, and for occupying a second firing configuration when the gun is in the firing condition; and a link connecting the first and second component, wherein a manipulation of the first component from the first travelling configuration to the first firing configuration actuates a relocation of the second component between the second travelling configuration and the second firing configuration.

Advantageously, such a carriage can be converted between conditions quicker than a carriage having only independently manipulated components. This means that the gun can be redeployed, so as to be ready to fire, in less time. This increases the rate at which the field gun can fire from a plurality of positions and thus offers a tactical advantage on the battlefield Preferably the first component is rotatable about a pivot axis and the manipulation of the first component is a rotation about the pivot axis. It is further preferable that the first component has an elongate form so as to present a substantial moment arm extending from the pivot axis.

Beneficially, the rotatable elongate form allows an operator to apply a greater force to the second component for the same amount of work done to the back leg. Thus if the second component requires a substantial force to relocate it, it can be more easily relocated.

Preferably the second component is extensible and the relocation of the second component is a linear extension or retraction.

Such relocation will require a substantial force if the extension lifts the gun and beneficially, the use of the moment arm will facilitate this mode of relocation.

Preferably the first component is a structural member suitable for resting on a ground plane in the firing condition, the first component resting on the ground plane at a back ground contact point. In further preference, the second component is a structural member suitable for forming a base whereby the field gun may rest on a ground plane in the firing condition, the second component resting on the ground plane at a front ground contact point.

Forces from the firing of the projectile will therefore be transmitted through the components if they rest on the ground. For a component to be suitable for resting on the ground, it must therefore be sufficiently strong so as to avoid failing under the firing forces.

Preferably the carriage defines a pitch, the pitch being a distance between the forward ground contact point and the back ground contact point when the field gun is in the firing condition, the carriage further comprising:

a central body for mounting a gun cradle on;

a first joint connecting the central body to the second component, such that in the firing condition the central body can rotate about a pivot axis at the first joint, to vary the elevation of the gun cradle;

a second joint connecting the central body to the first component, wherein the link connects the first component and second component such that as the elevation of the gun varies, the second component relocates to tend to maintain the pitch.

Beneficially this prevents the pitch from reducing and so the counter topple performance of the gun does not deteriorate with differing aim elevations. Further, because this happens automatically, no time need be spent by the crew maintaining the pitch through manual adjustments.

Preferably the first component is a back leg which in the first travelling configuration is disengaged from the ground plane Since it is generally a necessary stage in the conversion of a field gun to disengage a back leg from the ground (e.g. because the back end of the back leg has become embedded in the ground), the back leg will be a focus of attention for the operating crew's manpower. By saving the operating crew from attending to other parts of the field gun (e.g. the front leg), the gun can be converted quicker.

Preferably the second component is a retractable front leg comprising a wheel for contacting the ground plane at a forward ground contact point such that when the front leg is fully retracted towards the carriage, the retractable front leg is in the second travelling configuration Advantageously, when converting from the travelling condition to the firing condition, the front leg extends. Therefore the pitch is increased relative to an equivalent front leg that does not extend. Thus the gun is better suited to withstanding toppling moments.

It is likely that the manipulation of the first component is effected in part by the gravitational potential of the first component in which case it is preferable that the link is damped so as to dissipate the gravitational potential and effect a controlled manipulation.

For example, the back leg of a field gun that is pivoted at one end and rotated through approximately 180 degrees will tend to fall in all situations other than when the centre of gravity of the leg is held vertically over the pivot. If such a back leg were dropped from a position just off vertical, then it could cause considerable damage to any operator who was positioned between the leg and the ground if its motion was not damped. Damping, e.g. of the rotation of the back leg, makes the gun safer to convert because it reduces the speed at which the back leg rotates.

Optionally, the carriage is provided with a third component for occupying a third travelling configuration when the gun is in the travelling condition, and for occupying a third firing configuration when the gun is in the firing condition, wherein the actuator is connected to the third component such that a manipulation of the first component from the first travelling configuration to the first firing configuration actuates a relocation of the third component between the third travelling configuration and the third firing configuration. In particular, it is preferable that the third component is an additional front leg.

Such an arrangement allows both the second and third components can be actuated by a single manipulation of the first component. This can be beneficial where the components are light enough to be manipulated by the manpower which is able to access the component. Thus the conversion is accelerated.

In an alternative option there is provided a third component for occupying a third travelling configuration when the gun is in the travelling condition, and for occupying a third firing configuration when the gun is in the firing condition, and a fourth component for occupying a fourth travelling configuration when the gun is in the travelling condition, and for occupying a fourth firing configuration when the gun is in the firing condition wherein the link is connected to the fourth component such that a manipulation of the fourth component from the first travelling configuration to the fourth firing configuration actuates a relocation of the third component between the third travelling configuration and the third firing configuration. It is particularly preferred that the fourth component is an additional back leg and the third component is an additional second front leg.

This allows actuation by simultaneous movement of two components; in particular two back legs are moved to actuate two front legs. This type of actuation can be beneficial in situations where there is likely to be an abundance of manpower but limited space for the manpower to access a single component.

Figure 1B:
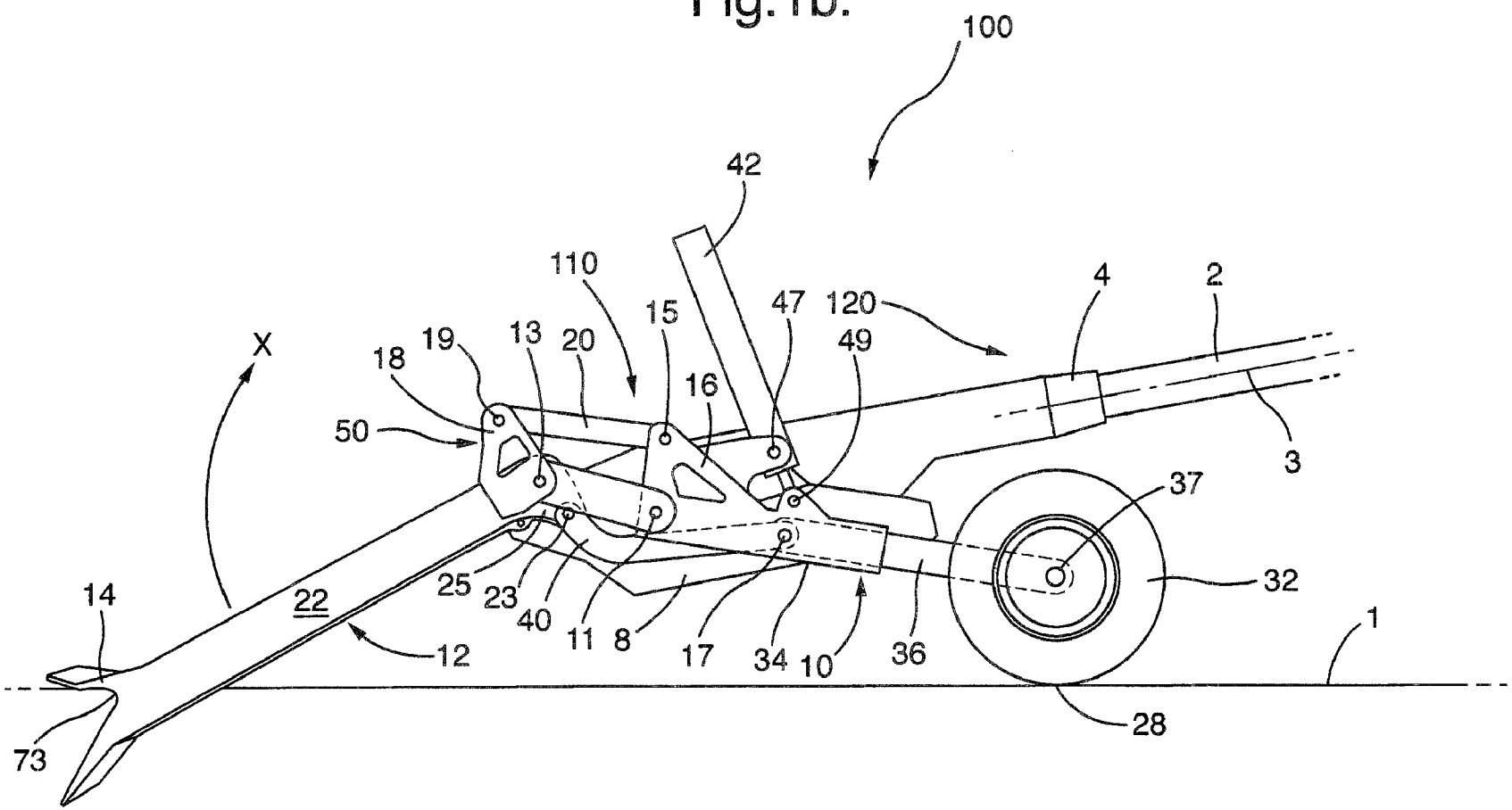

A first and second embodiment of the carriage, as may be incorporated into a field gun, will now be described by way of example and with reference to the following figures of which:

FIG. 1*a* shows a side view of a first embodiment of a field gun carriage incorporated into a field gun and in the firing condition;

FIG. 1*b* shows a side view of the field gun and field gun carriage of FIG. 1*a* in the travelling condition.

Figure 2A:
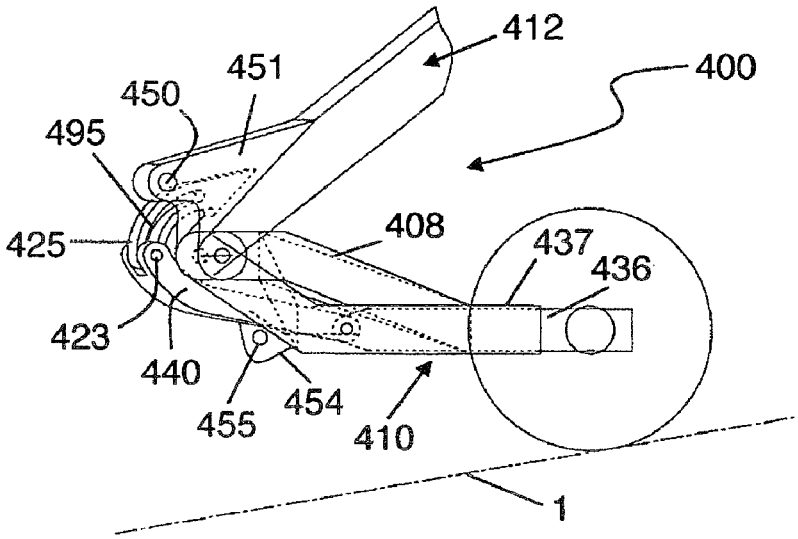
Figure 2B:
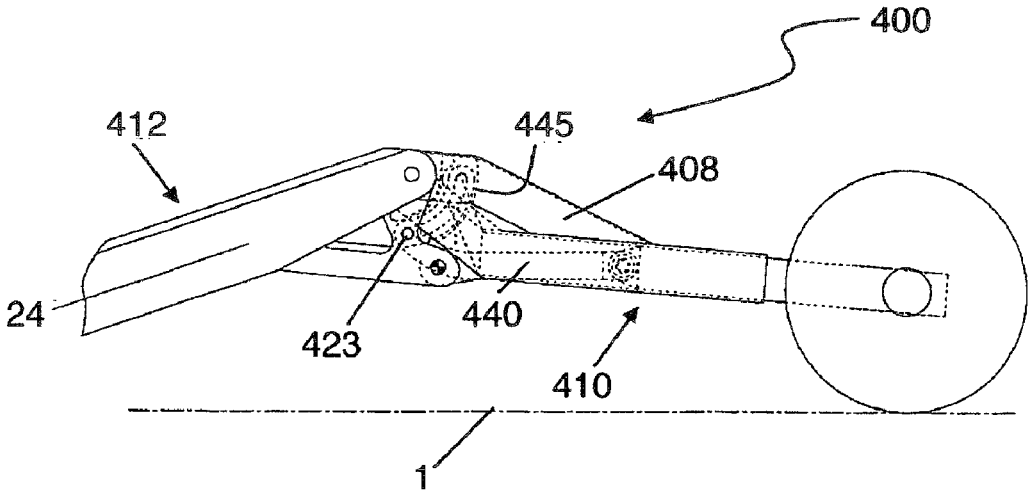
Figure 2C:
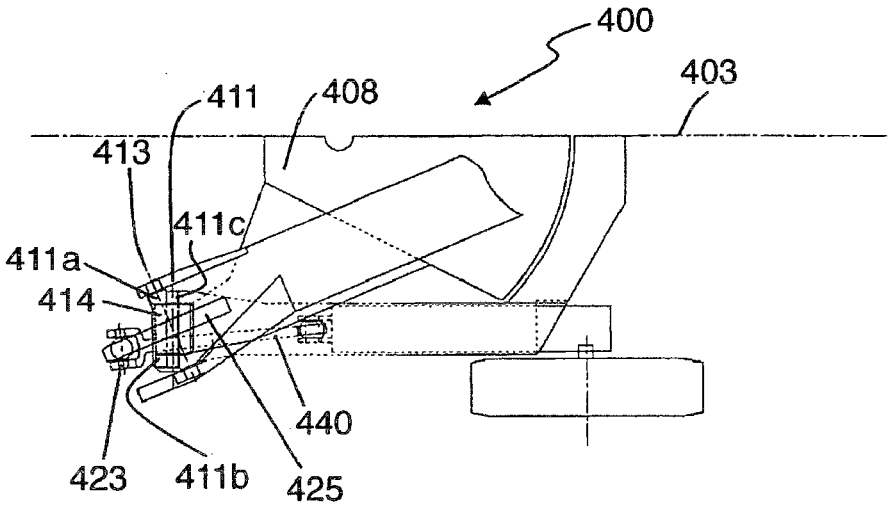
Figure 2D:
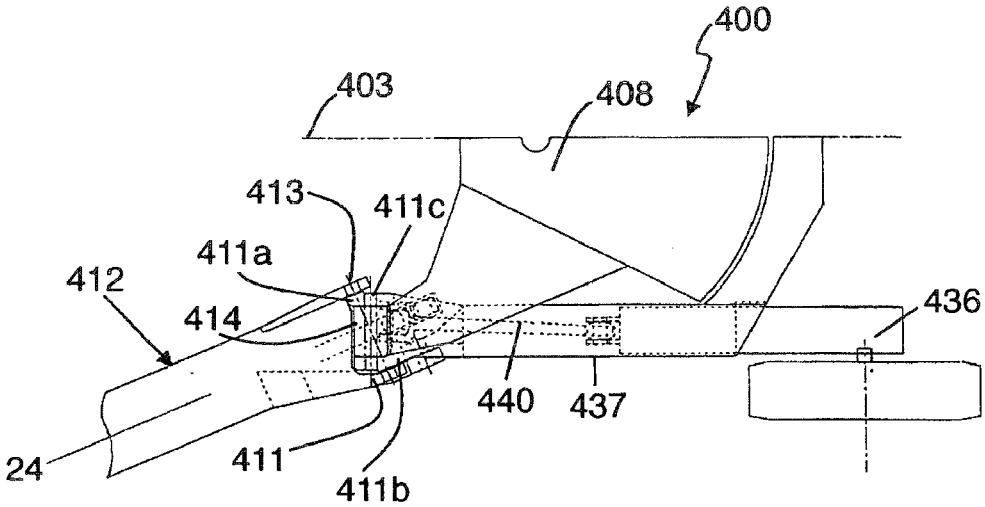

FIG. 2*a* shows a side view of a second embodiment of a field gun carriage, the second embodiment of the field gun carriage being arranged in a travelling condition;

FIG. 2*b* shows a side view of the field gun carriage of FIG. 2*a* arranged in a firing condition;

FIG. 2*c* shows a top-down view of the field gun carriage of FIGS. 2*a* and 2*b* arranged in a travelling condition;

FIG. 2*d* shows a top-down view of the field gun carriage of FIGS. 2*a*, 2*b* and 2*c* arranged in a firing condition.

Throughout the specification, references to 'front' or 'back' or 'forwards' or 'backwards' are to be interpreted in the accepted meaning in the art. For example, when the gun is in the firing condition, a component that is generally closer to the muzzle of the barrel than another component, is construed as being forwards of the other component.

Throughout the specification, references to 'up' or 'down' or 'upwards' or 'downwards' are to be interpreted in the accepted meaning of the art. For example, when the gun is in the firing condition and deployed on a ground plane, a component that is generally closer to the ground plane than another component, is construed as being downwards of the other component.

Referring to the FIGS. 1*a* and 1*b*, a field gun 100 comprises a carriage 110 and a cannon 120. The carriage 100 rests on a ground plane 1 and supports the cannon 120.

The cannon 120 comprises a cradle 4 and a barrel 2. The barrel 2 is able to slide within the cradle 4, along the axis 3 of the barrel, so that it may react to recoil forces and counter-recoil forces in a manner that tends to reduce the stress on components. The cradle 4 also provides the interface between the cannon 120 and the carriage 110: a bearing (not shown) connects a lower portion of the cradle 4 to a central body 8 of the carriage 110.

The carriage 110 comprises the central body 8, a back leg 12, a front leg 10, a link 40, an ear 50, a pantograph link 20 and a linear actuator 42.

The central body 8 is pivotally connected to the back leg 12 at a back joint 13 that allows the back leg 12 to rotate (e.g. X or Y) relative to the central body 8 about a pivot axis (which is not shown, but extends from the back joint 13 in a direction generally perpendicular to the page). The ear 50 comprises an ear lug 18 that extends upwards from the back joint 13.

The back leg 12 extends from the back joint 13 in two generally opposite directions. The substantial majority of the back leg 12 extends in a first direction and has a portion 22 with elongate form. This elongate form terminates at the back end of the back leg 12 where the back leg 12 has the form of a spade 14. The spade 14 contacts the ground 1 at a back contact point 73 when the gun is in the firing condition.

A lesser portion of the back leg 12 extends in a second direction to form a lever 25 that has formed in it an arcuate recess. Further, the lever 25 is pivotally connected at a lever pivot 23 to the back end of the link 40.

Back leg 12 also comprises a tenon (not shown) that interlocks with a mortise (not shown) formed in the ear 50 when the back leg 12 is fully relocated to its firing configuration.

Thus the back leg 12 and the ear 50 are rigidly connected when the gun 100 is in the firing condition.

The ear 50 is pivotally mounted at back joint 13 and extends upwards to form an ear lug 18 which is pivotally connected to the pantograph 20 at ear lug pivot 19.

When in the firing condition the lever joint 23 is forwards of the back joint 13 but when in the travelling position the lever joint 23 is backwards of the back joint 13.

Also pivotally connected to the central body 8 is the front leg 10. The pivotal connection between the central body 8 and the front leg 10 occurs at a front joint 11 and allows relative rotation between body 8 and leg 10. The front joint 11 is positioned on the central body 8 and forwards of the back joint 13.

The front leg 10 comprises a sleeve 34, an arm 36 and a wheel 32. The arm 36 slides within the sleeve 34 thereby allowing the front leg 10 to retract or extend. The wheel 32 is for contacting the ground at a front contact point 28, and is rotatably mounted on a bearing 37 at the front end of the arm 36.

The sleeve 34 forms, at a front joint 11, the connection between the central body 8 and the front leg 10. The sleeve 34 comprises a lug 16 that extends upwards from the front joint 11, and comprises at sleeve pivot 49 a connection to the linear actuator 42. The sleeve pivot 49 is forward of the front joint 11.

The arm 36 is connected at is back end to a front end of the link 40 by way of an arm pivot 17. A slot (not shown) is provided in the sleeve 34 so that the link 40 can extend from the arm pivot 17, out of the sleeve 34 and towards the back leg 12.

The back end of the link 40 is curved: firstly so as to fit into the reciprocal arcuate recess in the back leg lever 25 when the gun is in the travelling configuration; and secondly to avoid obstruction of the front joint 11 when in the firing configuration.

The pantograph link 20 connects the ear lug 18 and the sleeve lug 16 at the respective pivot joints 19 and 15.

The linear actuator 42 is pivotally connected at one end of the sleeve 34 by means of the sleeve pivot 49, and also pivotally connected to the central body 8 by means of pivot joint 47.

For the sake of clarity the figures show only one side of the carriage 110, for example only a single back leg 12 and a single front leg 10 are visible. However, the field gun 100 has a far side which is provided with equivalent carriage components to those described and illustrated (excepting the central body 8 of which there is only one).

Thus the field gun carriage 110 is generally symmetrical, having a front leg and back leg pair each having a distinct link for connecting the front leg to the respective back leg In operation, the aforementioned arrangement of components allows the front leg 10 of the field gun 100 to be converted from the firing condition to the travelling condition by manipulating the back leg 12.

When the gun 100 is in the firing condition as shown in FIG. 1, a conversion can be effected by rotating the back leg 12 about the back joint 13 so as to relocate the front leg 10.

This rotation can be undertaken manually by a crew of operators. The back leg 12 is particularly suitable for such manipulation because it is arranged in a readily accessible position and moreover because the proportions of the leg 12 (especially the elongate portion 22) mean that there is a considerable moment arm from the back end of the leg 12 to the back joint 13.

Prior to converting the gun from the firing condition to the travelling condition it may be necessary to extract the spade 14 from an embedded position in the ground 1. If it is not possible for the crew alone to extract the spade 14, then the extraction may be done by pulling the gun 100 at the muzzle of the barrel 2 with a propulsion means. Once the spade 14 is sufficiently detached from the ground so that crew members may lift the back leg 12, the conversion may commence.

During the conversion from the firing arrangement of FIG. 1, as the back leg 12 is rotated in a clockwise direction X about pivot joint 13, the back end of the link 40 also rotates clockwise about pivot joint 13 because it is connected to the lever 25 of leg 12 at lever joint 23.

As the back end of the link 40 rotates clockwise about joint 13, link 40 is drawn generally backwards.

As the link 40 is drawn backwards, the arm 36 which is connected at the joint 17 to the front end of the link 40 is retracted into the sleeve 34. The link 40 is generally in tension throughout this operation.

As the back leg 12 is fully rotated to reach the travelling configuration, occupying a position over the central body 8, the arm 36 simultaneously reaches the fully retracted position and thus the gun 100 is in the travelling condition, as depicted in FIG. 2.

Conversely, when the gun 100 is in the travelling condition as shown in FIG. 2, it can be converted to the firing condition by rotating the back leg 12 about back joint 13 in an anti-clockwise direction Y.

As back leg 12 is rotated from its travelling configuration to its firing configuration, the link 40 is placed under a generally compressive load which tends to push arm 36 out of sleeve 34 thus extending front leg 10 and thereby relocating the front leg 10 between the travelling and firing configuration.

In order to push arm 36 out of sleeve 34, any associated resistance forces at the interface of these components (e.g. friction) must be overcome.

When the back leg 12 reaches a point where it may fall under its own weight (which is generally the case whenever the back leg is neither resting nor vertical) these resistance forces can advantageously tend to dampen the motion of the back leg 12 left to rotate under its own weight.

Thus, the sleeve 34 and arm 36 are interfaced so as to provide damping to back leg 12.

Without such damping forces, the back leg 12 might fall into the firing configuration at a speed that was dangerous to nearby crew.

In the firing condition, a further operational effect of the carriage 110 is as follows.

When the cannon 120 is being elevated so as to aim the gun 100, the aim being effected by the extension of the linear actuator 42, the arrangement of the ear lug 18, pantograph 20 and sleeve lug 16 is such that in the absence of the link 40, there is a tendency for the pitch, i.e. the distance between front and back ground contact points 28 and 73, to reduce. This is disadvantageous because the reduced pitch is less stable particularly with regard to counteracting counter recoil tipping moments.

However, the link 40 connecting the lever 25 of the back leg 12 to the arm 36 of the front leg 10, automatically extends the front leg 10 as the body 8 rotates. This automatic extension as a result of barrel elevation tends to maintain the pitch.

In general, the muzzle of the gun barrel 2 will need to be supported for both conversion operations. Otherwise the central body 8 would tend to fall to the ground as back leg 12 was rotated in direction X. However, because the gun may be towed from the muzzle, this support can be easily provided by a towing pintle (or other towing attachment means) of a propulsion vehicle such as a truck. In the absence of a propulsion vehicle, should the need to convert the gun arise, some of the operating crew may provide the required support at the muzzle.

A variant form of the field gun 100 occurs if a single link connects a single back leg to two front legs and accordingly effects the relocation of said front legs.

In the above embodiment, the link 40 is a generally rigid member made from a single piece of material having suitable properties in compression and tension.

A carriage 400 that is an alternative to the carriage 110 is shown in FIGS. 2*a*-2*d*. The alternative carriage 400 comprises a back leg 412, a front leg 410, a central body 408, and a link 440.

For the sake of simplifying the figures, the carriage 400 is not shown as incorporated into a field gun. However, it would be apparent to the skilled reader how the carriage 400 could be incorporated into a field gun. For example, it would be apparent how a cradle and barrel (equivalent to cradle 4 and barrel 2) could be rotatably mounted onto the central body 408, and how to connect a linear actuator (equivalent to actuator 42) between the front leg 410 and the central body 408.

The front leg 410 of carriage 400 is joined to the central body 408 at a front joint 411. Front joint 411 is a pivot formed by: a bifurcation (formed of tines 411*a* and 411*b*) at the backward end of the front leg 410; a circular cylindrical fist 414 provided on a limb of the central body 408; and a pin 411*c*. The fist 414 fits between tines 412*a* and 412*b*, and the pin 411*c* extends through the tines 412*a* and 412*b*, and the fist 414. As such the pin 411*c* defines the axis of front joint 411 about which the front leg 410 rotates relative to the central body 408.

The axis of front joint 411 is generally perpendicular to the centre line of the gun 403 and is generally parallel to the ground plane 1. As such, the front joint 411 acts as a trunnion, enabling the central body 408 (and any cannon resting thereon) to elevate.

The back leg 412 is joined to the front leg 410 at back leg joint 413. Joint 413 is a pivot formed by: a bifurcation at the forward end of the back leg 412; the backward end of the front leg 410; and two pins. The bifurcation fits around the back end of the front leg 410 and each tine of the bifurcation is rotatably pinned, along a common axis, to an outer surface of the front leg 410. A back joint axis is thereby defined, which is inclined by approximately 30 degrees to the front pivot joint 411 axis in the plane of the page of FIGS. 2*c* and 2*d*.

The forward end of the back leg 412 is further provided with a back leg lever 425. The back leg lever 425 extends in the opposite direction to the elongate portion of the back leg and from the side of the back leg that is downwards when the gun is in the firing condition. The back leg lever 425 further extends along an arcuate path, the arcuate path being generally defined by a sector of a circle centred on the back joint axis 413. The tip of the back leg lever 425 ends in a region generally between the tines of the back leg bifurcation, and generally at a back leg axis 24. The back leg axis 24 is defined by the elongate and substantially straight form of the back leg 412. The back leg axis 24 passes through the centroid of the back leg cross-section.

The back leg lever 425 is provided with an arcuate slot 495, in which a pin 423 of link 440 is slideably disposed. Sliding pin 423 comprises a spherical, low friction surface for slideable disposal in slot 495 and as such, allows back leg 412 to swivel at pin 423 as well as rotate about pin 423. A pin with a spherical, low friction surface connects the link 440 to the front arm 436. With such connections the link 440 can, as may be necessary given the inclination of joint 411 to 413, occupy a range of inclinations to the centre line 403 (in the plane of the page of FIGS. 2*c* and 2*d*) to facilitate the conversion.

The back leg 412 is further provided with a lug 451 that extends from the back leg 412 such that when the back leg 412 is in the firing position, the lug 451 extends generally downwards and may selectively affix, by means of a bolt (not shown) extending through a hole 450 disposed in the lug 451 and a corresponding hole 455 on a corresponding lug 454 on the underside of the front leg 410.

A pocket 445 is formed in the central body 408 to accommodate the back leg lever 425 when the gun is in the firing condition.

In operation, and starting from the travelling condition shown in FIGS. 2*a* and 2*c*, the gun can be converted into a firing condition by rotating the back leg 412 about the back leg joint 413 to bring the back leg 412 towards the ground plane 73.

For approximately the first 90° of the rotation of the back leg 412 from the travelling configuration, the pin 423 at the backward end of the link 440 slides relative to the back leg lever 425 along the path defined by the slot 495. For this first 90° of rotation, the front leg 410 remains in its travelling configuration. Towards the end of this initial 90° of rotation, the pin 423 abuts the back end of the slot 495. With the pin 423 abutting the back end of the slot 495, continued rotation of the back leg 412 now pushes the link 440 forwards, which in turn pushes the arm 436 forwards relative to the sleeve 434. Thus the front leg 410 extends, thereby increasing the pitch of the carriage and thereby increasing the stability of the carriage.

As the back leg 412 continues to rotate past 90°, the back leg lever 425 enters the pocket 445 formed in the central body 408.

Meanwhile the lug 451 on the back leg 412 moves towards a position where it may connect with a corresponding lug 454 on the front leg 410. Connection becomes possible when the gun is arranged in the firing condition.

The connection between the lugs prevents rotation between the front and back legs about joint 413. Thus, in the firing condition the central body 408 pivots about joint 411 in order to vary the firing elevation.

The inclination of the axis of joint 411 to that of joint 413 causes the width of the carriage 400 in the firing and travelling conditions to vary as the back leg 412 rotates: therefore the carriage 400 is narrower when in the travelling condition so as to fit into smaller spaces (such as the bay of an aircraft); and therefore the carriage 400 forms a wider base when in the firing condition to improve the gun's stability.

It can be seen from the figures that the mechanism of the alternative carriage 400 can be expected to simplify the carriage structure in so far as it obviates the need for the pantograph link 20. Such simplification can tend to reduce the mass of the field gun.

Having thus explained how to convert the carriage 400 from the travelling condition to the firing condition, it will be apparent how to convert the carriage 400 from the firing condition back to the travelling condition.

Further, when converting the carriage 400 from a firing condition to a travelling condition, the front leg lever 425 need not actuate the link 440 until it has rotated approximately 90 degrees. Such actuation-free travel reduces the force required to initially lift the back leg 412, which may be particularly useful if the spade is firmly embedded in the ground plane 1 and the gun is to be manipulated by manpower alone. However, provision may be made so that the pin 423 can be secured in the slot 495 so that the field gun may be pulled from a spade-embedded deployment by a vehicle.

As a variant on the above embodiments, the link 40 (or the link 440) may comprise an actuator such as a hydraulic piston. The provision of an actuator within the link could enable a greater force to be applied to rotate the back leg 12 (or back leg 412) and effect the conversion. This would be likely to allow the back leg 12 to be extracted from the ground 1 more easily as might be required if the spade is otherwise held fast in the ground. The provision of a hydraulic piston in the actuator would also tend to reduce the number of crew required.

The field gun may be made out of any materials known in the art to be suitable. Various steel alloys, titanium alloys and composite materials may be suitable depending on the in service requirement. Members, such as the front and back legs, may be formed substantially from a range of cross-sections. In particular, members such as the front and back legs may be formed from a beam having a hollow rectangular cross-section.

Whilst the example described above may relate to a 155 mm caliber field gun, the invention is not intended to be limited to a particular caliber. The invention could, for example, be embodied in a 105 mm caliber field gun.

The invention claimed is:

1. A carriage for a field gun, the field gun being convertible between a travelling condition and a firing condition, the carriage comprising:

a first component for occupying a first travelling configuration when the gun is in the travelling condition, and for occupying a first firing configuration when the gun is in the firing condition;

a second component for occupying a second travelling configuration when the gun is in the travelling condition, and for occupying a second firing configuration when the gun is in the firing condition, the second component comprising an extensible front leg having a wheel for contacting the ground plane at a front ground contact point in both the second travelling configuration and the second firing configuration; and a link connecting the first and second component, wherein a manipulation of the first component from the first travelling configuration to the first firing configuration actuates a relocation of the second component between the second travelling configuration and the second firing configuration while maintaining contact between the wheel and the ground plane.

2. A carriage according to claim 1 wherein the first component is rotatable about a pivot axis and the manipulation of the first component is a rotation about the pivot axis.

3. A carriage according to claim 2 wherein the first component has an elongate form so as to present a substantial moment arm extending from the pivot axis.

4. A carriage according to claim 1 wherein the relocation of the second component is a linear extension or retraction.

5. A carriage according to claim 1 wherein the first component is a structural member suitable for resting on a ground plane in the firing condition, the first component resting on the ground plane at a back ground contact point.

6. A carriage according to claim 5, the carriage defining a pitch, the pitch being a distance between the forward ground contact point and the back ground contact point when the field gun is in the firing condition, the carriage further comprising:

a central body for mounting a gun cradle on;

a first joint connecting the central body to the second component, such that in the firing condition the central body can rotate about a pivot axis at the first joint to vary the elevation of the field gun; and a second joint connecting the central body to the first component, wherein the link connects the first component and second component such that as the elevation of the gun varies, the second component relocates to tend to maintain the pitch.

7. A carriage according to claim 1 wherein the first component is a back leg which in the first travelling configuration is disengaged from the ground plane.

8. A carriage according to claim 1 wherein when the front leg is fully retracted towards the carriage, the retractable front leg is in the second travelling configuration.

9. A carriage according to claim 1 wherein the manipulation of the first component is effected in part by the gravitational potential of the first component and wherein the link is damped so as to dissipate the gravitational potential and effect a controlled manipulation.

10. A carriage according to claim 1 further comprising:

a third component for occupying a third travelling configuration when the gun is in the travelling condition, and for occupying a third firing configuration when the gun is in the firing condition, wherein the link is connected to the third component such that a manipulation of the first component from the first travelling configuration to the first firing configuration actuates a relocation of the third component between the third travelling configuration and the third firing configuration.

11. A carriage according to claim 10 wherein the third component is an additional front leg.

12. A carriage according to claim 1 further comprising:

a third component for occupying a third travelling configuration when the gun is in the travelling condition, and for occupying a third firing configuration when the gun is in the firing condition; and a fourth component for occupying a fourth travelling configuration when the gun is in the travelling condition, and for occupying a fourth firing configuration when the gun is in the firing condition, wherein the link is connected to the fourth component such that a manipulation of the fourth component from the first travelling configuration to the fourth firing configuration actuates a relocation of the third component between the third travelling configuration and the third firing configuration.

13. A carriage according to claim 12 wherein the first component is a back leg which in the first travelling configuration is disengaged from the ground plane, the fourth component is an additional back leg and the third component is an additional second front leg.

* * * * *